US006979491B2

(12) United States Patent
Yan et al.

(10) Patent No.: US 6,979,491 B2
(45) Date of Patent: Dec. 27, 2005

(54) ANTIMICROBIAL YARN HAVING NANOSILVER PARTICLES AND METHODS FOR MANUFACTURING THE SAME

(75) Inventors: Jixiong Yan, Wuhan (CN); Jiachong Cheng, Beijing (CN)

(73) Assignee: CC Technology Investment Co., Ltd., Hong Kong (CN)

( * ) Notice: Subject to any disclaimer, the term of this patent is extended or adjusted under 35 U.S.C. 154(b) by 317 days.

(21) Appl. No.: 10/106,033

(22) Filed: Mar. 27, 2002

(65) Prior Publication Data

US 2003/0190851 A1 Oct. 9, 2003

(51) Int. Cl.[7] ..... D02G 3/00

(52) U.S. Cl. ..... 428/361; 57/232; 424/403; 424/404; 424/405; 424/402; 424/1.29; 106/1.13; 106/1.14; 106/1.18; 106/1.19; 106/2; 428/365; 428/907; 442/123; 442/124

(58) Field of Search ..... 106/1.13, 1.14, 106/1.18, 1.19, 2, 15.05; 442/123, 124, 1.29, 402, 403–405; 428/361, 365, 907; 57/232

(56) References Cited

U.S. PATENT DOCUMENTS

| | | | |
|---|---|---|---|
| 4,525,410 A | 6/1985 | Hagiwara et al. | |
| 5,064,599 A | 11/1991 | Ando et al. | |
| 5,180,402 A | 1/1993 | Kubota et al. | |
| 5,496,860 A | 3/1996 | Matsumoto et al. | |
| 5,561,167 A | 10/1996 | Matsumoto et al. | |
| 5,897,673 A | 4/1999 | Nishida et al. | |
| 5,985,301 A | 11/1999 | Nakamura et al. | |
| 6,274,519 B1 | 8/2001 | Omori et al. | |
| 6,379,712 B1 | 4/2002 | Yan et al. | |
| 6,607,994 B2 * | 8/2003 | Soane et al. | 442/59 |

FOREIGN PATENT DOCUMENTS

| | | |
|---|---|---|
| CN | 1034090 C | 2/1997 |
| CN | 1291666 A | 4/2001 |
| CN | 1291667 A | 4/2001 |
| FR | 2108030 A | 12/1972 |
| JP | 2003-136649 A | 5/2003 |
| KR | 2001-0091023 A | 10/2001 |

* cited by examiner

*Primary Examiner*—Arti R. Singh
(74) *Attorney, Agent, or Firm*—Wilkinson & Grist; George G Wang; Charles S Ho

(57) ABSTRACT

The present invention provides a yarn with antimicrobial effects. The antimicrobial antifungal effect of the yarn is derived from nanosilver particles (diameter between 1 and 100 nm) which are adhered to the yarn. The yarn contains fibers which are made of cotton, linen, silk, wool, leather, blending fabric, synthetic fiber, or any combination thereof. The yarn can be used to make cloth to be used particularly for treating patients with burns or wound. The cloth made from the antimicrobial yarn can be further used to make clothes such as underwears, socks, shoe cushions, shoe linings, bed sheets, pillow cases, towels, women hygiene products, laboratory coats, and medical robes. The present invention also provides a method for making the antimicrobial yarn.

19 Claims, 2 Drawing Sheets

ANTIMICROBIAL YARN HAVING NANOSILVER PARTICLES AND METHODS FOR MANUFACTURING THE SAME

FIELD OF THE INVENTION

The present invention relates to an antimicrobial yarn which contains about 0.2 to 1.5% by weight of nanosilver particles (diameter between 1 and 100 nm) adhered thereto. The nanosilver particles are prepared without the use of ammonia or ammonia water. The antimicrobial yarn is preferably used in making cloth particularly for treatment of patients with burns or wounds. The cloth can be used to make clothes such as underwear, socks, shoe cushions, shoe linings, bed sheets, pillow cases, towels, women hygiene products, laboratory coats, and medical robes. The present invention also relates to methods for making and using the antimicrobial fiber for healthcare and medical use.

DESCRIPTION OF THE RELATED ART

Metals including silver, copper, mercury, and zinc are known for anti-bacterial properties. Bacteria treated by these metals do not acquire resistance to the metals. Therefore, the bactericidal metals have advantages over the conventional antibiotics which often cause the selection of antibiotic-resistant microorganism.

Silver is generally a safe and effective antimicrobial metal. Silver ions function in adversely affecting cellular metabolism to inhibit bacterial cell growth. When silver ions are absorbed into bacterial cells, silver ions suppress respiration, basal metabolism of the electron transfer system, and transport of substrate in the microbial cell membrane. Silver ions also inhibit bacterial growth by producing active oxygen on the surface of silver powder and silver-plated articles. Silver has been studied for antibacterial purposes in the form of powder, metal-substituted zeolite, metal-plated non-woven fabric, and crosslinked compound.

Nano technology is the study and treatment of substance and material in a nanometer range. Nanometer equals to $10^{-9}$ meter. The internationally acclaimed range for research and study for the nano technology is between 0.1 nm and 100 nm. The technology has been applied in the areas of information technology, energy, environment, and biotechnology. Particularly, the technology has been used in medicine including drug carrier, cell dye, cell separation, clinical diagnosis, and disinfection.

In the late eighteenth century, western scientists confirmed that colloidal silver, which had been used in oriental medicine for centuries, was an effective antibacterial agent. Scientists also knew that the human body fluid is colloidal. Therefore, colloidal silver had been used for antibacterial purposes in the human body. By the early nineteenth century, colloidal silver was considered the best antibacterial agent. However, after the discovery of antibiotics, due to the fact that antibiotics were more potent which could in turn generate more revenue, antibiotics had substituted colloidal silver as the main choice for antibacterial agents.

Thirty years after the discovery of the antibiotics, many bacteria developed resistance to the antibiotics, which became a serious problem. Since 1870s, silver, particularly colloidal silver, has once again been recognized for antibacterial use, particularly due to its ability for not causing drug-resistance.

Antibacterial cloth containing metallic particles (particularly copper, silver, and zinc in the form of zeolite) is known in the field for a long time. Many methods for incorporating the metal ions directly into a cloth or fabric have been proposed. However, in the methods in which the metals are used directly, the incorporation of metals lead to very expensive products, with heavy weights as they are necessarily used in a large amounts.

There are also methods teaching the use of a polymeric substance to hold the metallic ions. For example, the method of binding or adding fine wires or powder of the metals themselves to a polymer and the method of incorporating compounds of the metals into a polymer. However, the products obtained by these methods shows poor durability of antibacterial performance and can be utilized only for restricted purposes because the metal ions are merely contained in or attached to the polymer and, accordingly, they easily fall away from the polymer while being used.

For example, Japanese Patent No. 3-136649 discloses an antibacterial cloth used for washing breasts of milk cow. The $Ag^+$ ions in $AgNO_3$ are crosslinked with polyacrylonitrile. The antibacterial cloth has demonstrated anti-bacterial activity on six (6) bacterial strains including Streptococcus and Staphylococcus.

Japanese Patent No. 54-151669 discloses a fiber treated with a solution containing a compound of copper and silver. The solution is evenly distributed on the fiber. The fiber is used as an anti-bacterial lining inside boots, shoes, and pants.

U.S. Pat. No. 4,525,410 discloses a mixed fiber assembly composed of low-melting thermoplastic synthetic fibers and ordinary fibers which are packed and retained with specific zeolite particles having a bactericidal metal ion.

U.S. Pat. No. 5,180,402 discloses a dyed synthetic fiber containing a silver-substituted zeolite and a substantially water-insoluble copper compound. The dyed synthetic fiber is prepared by incorporating a silver-substituted zeolite in a monomer or a polymerization mixture before the completion of polymerization in the step of preparing a polymer for the fiber.

U.S. Pat. Nos. 5,496,860 and 5,561,167 disclose antibacterial fiber including an ion exchange fiber and an antibacterial metal ion entrapped within the ion exchange fiber through an ion exchange reaction. The ion exchange fiber has sulfonic or carboxyl group as the ion exchange group.

U.S. Pat. No. 5,897,673 discloses fine metallic particles-containing fibers with various fine metallic particles therein, which have fiber properties to such degree that they can be processed and worked, and which can exhibit various functions of the fine metallic particles, such as antibacterial deodorizing and electroconductive properties as provided.

U.S. Pat. No. 5,985,301 discloses a production process of cellulose fiber characterized in that tertiary amine N-oxide is used as a solvent for pulp, and a silver-based antibacterial agent and optionally magnetized mineral ore powder are added, followed by solvent-spinning.

The materials of the prior art involving the use of zeolite do not have sufficiently antibacterial activity due to lack of sufficient surface contact between the bactericidal metal and the bacteria, especially in water. The bactericidal activity of these materials rapidly diminishes as the silver ions become separated from the supports, especially in water. Most importantly, these materials do not show bactericidal activity over a prolonged period of time and the crosslinking may introduce compounds that cause allergy in patients.

There is yet another approach of making antibacterial cloth such as by inserting a layer of metallic yarn between a woven fabric. For example, Japanese laid-open patent publication (unexamined) No. Hei 6-297629 discloses an antibacterial cloth in which an inner layer member containing copper ion in a urethane foam resin is inserted in a cloth-like outer layer member. The outer layer member is composed of a cotton yarn serving as a weft formed by entangling an extra fine metallic yarn of copy or the like and a rayon yarn serving as a warp. A warp is the threads of a woven fabric which are extended longhtwise in the loom. A weft is the threads of a woven fabric that cross from side to side of the web and interlace the warp. This type of antibacterial cloth is heavy and hard. In addition, the extra fine metallic yarn is easy to cut, thus, causing problems to wash the cloth repeatedly. It may also injure a user due to the cut metallic yarn.

Recently, Chinese Patent No. 921092881 discloses a method for making antibacterial fabric with long lasting broad-spectrum antibacterial effect against more than 40 bacteria. The fabric is manufactured by dissolving silver nitrate in water, adding ammonia water into the solution to form silver-ammonia complex ion, adding glucose to form a treating agent, adding fabric into the treating agent, and ironing the fabric by electric iron or heat-rolling machine. The use of ammonia water in the reaction causes many problems. First, ammonia water has intense, pungent, suffocating odor which irritates skin and mucous membranes of workers. Second, ammonia water causes pollution to the environment. Finally, using ammonia water to manufacture silver-attached yarn is expensive.

The present invention provides an antimicrobial yarn having nanosilver particles adhered thereto that is very effective over a broad spectrum of bacteria, fungi, and virus. The antimicrobial fiber of the present invention does not lose the antimicrobial strength over time, and the fiber is especially effective in water. The yarn used in the present invention can contain natural or synthetic fibers; its color can be natural or dyed. The antimicrobial yarn of the present invention is non-toxic, safe, and thus, suitable for use in healthcare related purposes.

The present invention also provides a method for making the antimicrobial yarn which is very simple, fast, and easy to carry over. The use of ammonia or ammonia water is completely eliminated in the process of the present invention, thus, the method of the present invention is environmentally safe and non-irritating to workers. The method of the present invention also produces reliable results and can be applied in small and industrial scale production.

SUMMARY OF THE INVENTION

The present invention provides an antimicrobial yarn which contains nanosilver particles in the diameter of about 1–100 nm. The total weight of silver in the yarn is about 0.2 to 1.5% by weight. The nanosilver particles are adhered to the fibers of the yarn. Cotton, linen, silk, wool, blending fabric, or synthetic fiber or any combination therewith can be used as materials for the yarn. The yarn can be in its natural colored or dyed with different color.

The silver of the nanosilver particles is made by reducing silver nitrate with a reducing agent which is not ammonia or ammonia water. The preferred reducing agent is glucose, vitamin C, or hydrazine hydrate ($H_2NNH_2.H_2O$).

The yarn has antimicrobial effects against bacteria, fungi, and/or chlamydia, which include, but are not limited to, *Escherichia coli*, Methicillin resistant *Staphylococcus aureus, Chlamydia trachomatis, Providencia stuartii, Vibrio vulnificus*, Pneumobacillus, Nitrate-negative bacillus, *Staphylococcus aureus, Candida albicans, Bacillus cloacae, Bacillus allantoides*, Morgan's bacillus (*Salmonella morgani*), *Pseudomonas maltophila, Pseudomonas aeruginosa, Neisseria gonorrhoeae, Bacillus subtilis, Bacillus foecalis alkaligenes, Streptococcus hemolyticus* B, Citrobacter, and *Salmonella paratyphi* C.

The antimicrobial yarn can be used to make cloth (such as bandage, gauze, and surgical cloth) with antimicrobial activity, particularly to be used for treating patient with burn and scald-related related skin infection, wound-related skin infection, dermal or mucosal bacterial or fungal infection, surgery cut infection, vaginitis, and acne-related infection.

Additionally, the cloth with antimicrobial activity can be used to make antibacterial clothes or clothing such as underwear, socks, shoe cushions, shoe linings, bed sheets, pillow shams, towels, women hygiene products, laboratory coat, and patient clothes.

The present invention also provides a method for manufacturing the antimicrobial yarn. The method includes (1) mixing an aqueous solution of silver nitrate with an aqueous solution of a reducing agent to form a nanosilver particle-containing solution (the reducing agent is not ammonia or ammonia water); (2) soaking the yarn in the nanosilver particle-containing solution to attach said nanosilver particle to the yarn; and (3) dehydrating and drying the nanosilver particle-attached yarn to form the yarn with antimicrobial activity. Preferably, the yarn is pre-degreased before soaking in the nanosilver particle-containing solution. Additionally, after attaching the nanosilver to the yarn and before dehydrating and drying the nanosilver-particles attached yarn, the yarn can be treated with heat at 120–160° C. for about 40–60 minutes.

Also, preferably, the aqueous silver nitrate solution and said aqueous solution of reducing agent are mixed at 0–40° C., and/or until the mixture of the aqueous silver nitrate solution and the aqueous solution of reducing agent becomes colorless and/or transparent. The aqueous solution is preferably water solution. For each liter of the nanosilver particle-containing solution, it is preferred that it contains 2–40 g of silver nitrate, and 0.5–62 g of reducing agent, preferably glucose. The silver nitrate and said glucose in the nanosilver particle-containing solution is preferably at a ratio of about 0.03–80:1 by weight. The resulting nanosilver particles are sized between 1 to 100 nm in diameter and the antimicrobial yarn contains about 0.2% to 1.5% by weight of silver in a form of attached nanosilver particles.

Alternatively, the step of soaking the yarn in the nanosilver particle-containing solution can be replaced with a step of spraying the nanosilver particle-containing solution to the yarn by a jet sprayer.

DETAILED DESCRIPTION OF THE INVENTION

Figure 1A:
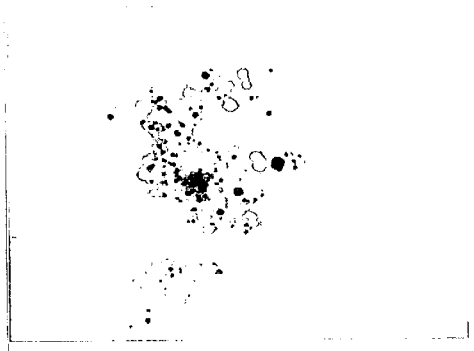
FIG. 1 is a transmission electron micrograph (JEM-100CXII) which shows a yarn evenly attached with nanosilver particles. The diameters of the nanosilver particles were below 20 nm. The total wt % of silver in the yarn was 0.4–0.9%. A: Batch No. 010110; B: Batch No. 001226; C: Batch No. 001230; D: Batch No. 010322-1; E: Batch No. 011323; F: Batch No. 010322-2.
Figure 1B:
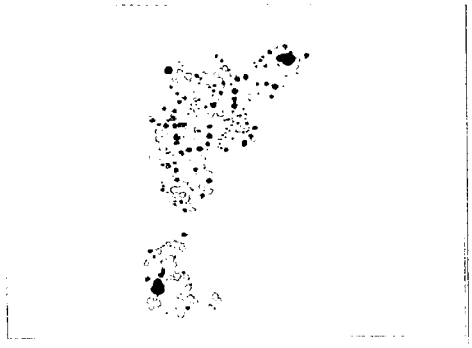
Figure 1C:
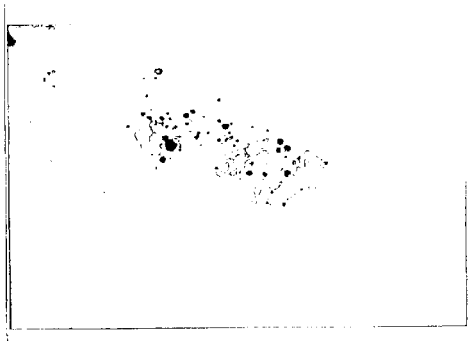
Figure 1D:
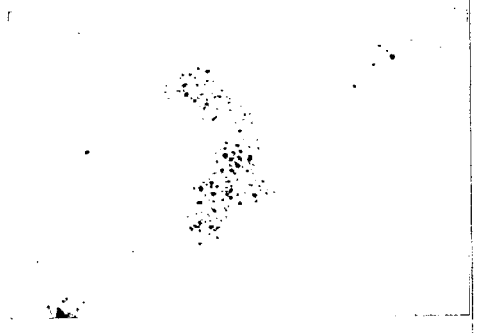
Figure 1E:
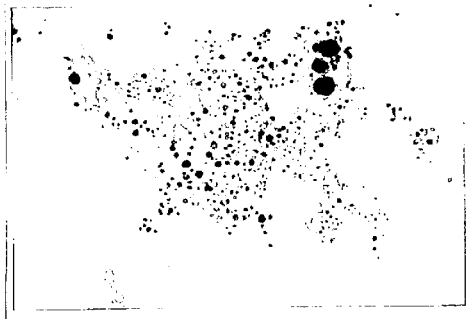
Figure 1F:
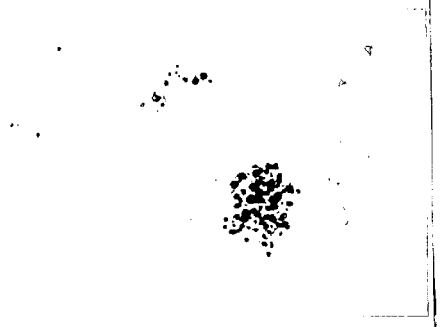

The present invention provides an antimicrobial yarn which has a long-lasting effect and a broad-spectrum antimicrobial activity. For the purpose of the present invention, a yarn means a continuous often plied strand composed of either natural or man-made fibers and used in weaving and knitting to form cloth. The antimicrobial yarn contains nanosilver particles having diameters in the range of 1 nm to 100 nm. The nanosilver particles are adhered to the fibers of the yarn and contribute to the antimicrobial effects. The silver content in the antimicrobial fiber is 0.2% to 1.5% by weight of the total weight of the yarn The fibers of the yarn are made of cotton, linen, silk, wool, leather, blending fabric, or synthetic fiber or a combination therewith. The yarn can be either in its natural color or dyed with various colors, and the antimicrobial capacity of the yarn (either in natural color or dyed with various colors) is retained.

The antimicrobial yarn of the present invention is non-toxic, safe, and thus, suitable for use in medical or healthcare related purposes. The antimicrobial yarn can be used to make an antimicrobial cloth. The cloth is suitable for use as bandage, gauge, or surgery cloth. It can also be used in making clothes or clothing such as underwear, panty, shoe cushions, shoe insole, shoe lining, bedding sheets, pillow sham, towel, feminine hygiene products, medical robes etc.

The term "antimicrobial" as used in the context of "antimicrobial yarn," "antimicrobial cloth," and/or "antimicrobial clothes or clothing" in the present invention means that the yarn, cloth, or clothes (or clothing) has demonstrated antibacterial, antifungal, and anti-chlamydia effects by killing and/or suppressing growth of a broad spectrum of fungi, bacteria, and chlamydia, such as *Escherichia coli*, Methicillin resistant *Staphylococcus aureus, Chlamydia* trachomatis, Providencia stuartii, Vibrio vulnificus, Pneumobacillus, Nitrate-negative bacillus, *Staphylococcus aureus, Candida albicans, Bacillus cloacae, Bacillus allantoides*, *Morgan's bacillus* (*Salmonella morgani*), *Pseudomonas maltophila, Pseudomonas aeruginosa, Neisseria gonorrhoeae, Bacillus subtilis, Bacillus foecalis alkaligenes, Streptococcus hemolyticus* B, Citrobacter, and *Salmonella paratyphi* C.

The antimicrobial effect of the present invention is derived from silver ions which have advantage over the conventional antibiotics, as it does not induce resistance in the microorganisms. The antimicrobial yarn of the present invention does not lose the antimicrobial strength over time, and the antimicrobial effects are especially stronger in water.

Specially, the antimicrobial yarn of the present invention is suitable for use as cloth or clothes in disinfecting and treating patient with burn and scald-related skin infection, wound-related skin infection, skin or mucosa bacterial or fungal infection, surgery cut infection, vaginitis, and acne-related infection.

The antimicrobial activity of the nanosilver particle can be explained by the following scheme using silver nitrate as the substrate and glucose as a reducing agent:

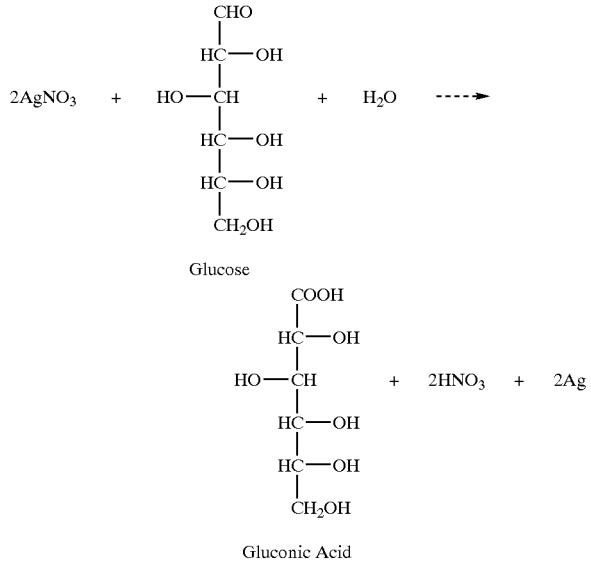

As shown above, the silver nitrate is reduced to metallic silver by interacting with glucose (where the glucose itself is oxidized to gluconic acid). It is important to note that the present invention does not use ammonia or ammonia water as reducing agent The antimicrobial activity of the silver can further be explained by the following reaction:

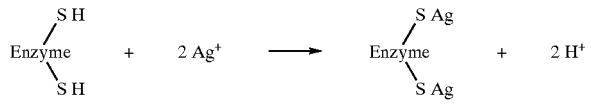

Silver nitrate is one of the most powerful chemical germicides and is widely used as a local astringent and germicide. However, the nitrates irritate the skin. Thus, it is preferable to reduce the silver nitrate to metallic silver. When the metallic silver is in contact with an oxygen metabolic enzyme of a microorganism, it becomes ionized. And, as shown in the above reaction, the silver ion interacts with the sulfhydryl group (—SH) of the enzyme in the microorganism and forms an —SAg linkage with the enzyme, which effectively blocks the enzyme activity.

Figure 2:
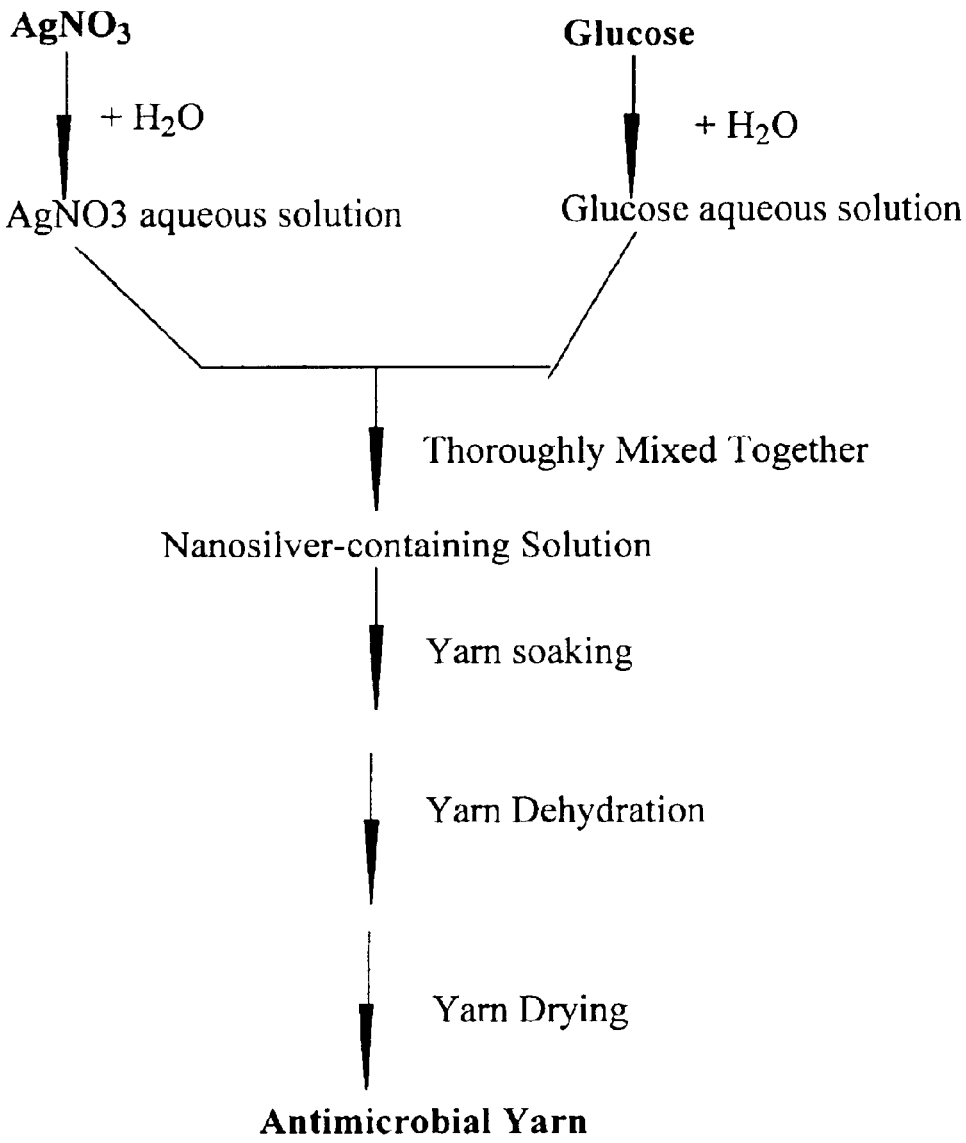
FIG. 2 shows a flow chart for the preparation of the antimicrobial yarn.

The antimicrobial yarn of the present invention is prepared according to the flow chart as shown in FIG. 2:

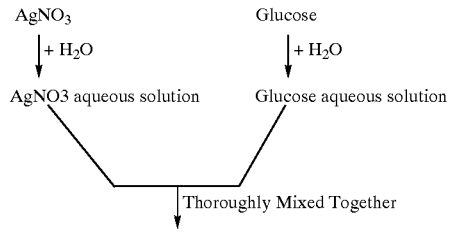

-continued

Nanosilver-containing Solution

↓ Yarn soaking

↓ Yarn Dehydration

↓ Yarn Drying

Antimicrobial Yarn

First, dissolving silver nitrate and a reducing agent respectively in water to form an aqueous solution of silver nitrate and an aqueous solution of the reducing agent. It is noted that a direct mixing of the solid forms of silver nitrate and reducing agent in an aqueous solution is not encouraged because it may result in an uncontrollable reaction. The aqueous solution of silver nitrate is then mixed and stirred with the aqueous solution of the reducing agent at 0–40° C., preferably at 25° C., until a colorless and transparent aqueous solution is formed, which contains nanosilver particles. The nanosilver particles-containing aqueous solution is used as the soaking solution for the yarn. The reducing agent can be glucose, vitamin C or hydrazine hydrate, preferably, glucose. For 200 kg of yarn, about 1–20 kg of silver nitrate, about 0.25–31 kg of glucose, and about 500 L (litres) of water are required.

The yarn is preferred to be de-greased prior to the soaking. The degreased process for the yarn is commonly known in the art. After soaking in the nanosilver particles-containing solution for an appropriate period of time, the soaked yarn is dehydrated followed by drying under heat.

The resulting antimicrobial yarn has advantages of long-lasting effect, broad spectrum antimicrobial activity, non-toxic, non-stimulating, natural, and suitable for medicinal uses. The antimicrobial activity of the yarn is stronger when in water. Because liquid ammonia is not used in the process for making the antimicrobial fiber, the process is more environmentally friendly and safer for workers. The process of the present invention is suitable for both small scale and industrial scale production.

The following examples are illustrative, and should not be viewed as limiting the scope of the present invention. Reasonable variations, such as those occur to reasonable artisan, can be made herein without departing from the scope of the present invention.

EXAMPLE 1

Preparation of the Small Scale of Antimicrobial Yarn (1) Preparation of Nanosilver Particles-Containing Solution:

(a) Silver Nitrate Solution:

$AgNO_3$ 3.9 g

Dissolved in 150 ml of Water (b) Reducing Solution:

Glucose 2.1 g

Dissolved in 100 L of Water

The nanosilver particle-containing solution was prepared by mixing the silver nitrate solution with the reducing agent solution thoroughly at room temperature (25° C.) to form a transparent and colorless treatment solution.

(2) Preparation of Antimicrobial Yarn:

The antimicrobial yarn was prepared as follows:

(i) Naturally white, degreased yarns (10 g) were immersed in the nanosilver particles-containing solution of (1). The yarns were squeezed and rolled in the solution so that the yarns were fully absorbed with the treatment solution.

(ii). The nanosilver particles-containing solution was removed from the yarns by centrifugation (such as in a washing machine) and dried in an oven at 120–160° C.

(iii). The dried yarns were washed by water, squeezed to dry, and dried again in the oven to obtain the antimicrobial yarn of the present invention which showed an orange color.

The process in (i) could be replaced with spraying the solution of (1) to the yarn by a jet sprayer.

EXAMPLE 2

Preparation of Industrial Scale of Antimicrobial Yarn (1) Preparation of Nanosilver Particles-Containing Solution (a) Silver Nitrate Solution:

$AgNO_3$ 5.5 kg

Dissolved in 200 L of Water

The silver nitrate aqueous solution was prepared by dissolving 5.5 kg of silver nitrate in 200 L of water at room temperature in a 500-litre reaction container.

(b) Reducing Solution:

Glucose 5.7 kg

Dissolved in 150 L of Water

The aqueous solution of Glucose was prepared by dissolving 5.7 kg of glucose at room temperature in 150 L water in a 200-litre reaction container to form an aqueous solution of glucose.

(c) Nanosilver Particles-Containing Solution:

The nanosilver particle-containing solution was prepared by mixing the silver nitrate solution with the reducing agent solution. Additional water was added to the mixture to make the volume up to 500 L. The mixture was stirred thoroughly at room temperature (25° C.) until a transparent and colorless solution was formed.

(2) Preparation of Antimicrobial Yarn:

The antimicrobial yarn was prepared as follows:

(i). Naturally white, degreased yarns (200 kg) were immersed in the nanosilver particles-containing solution of (1). The yarns were squeezed and rolled in the solution so that the yarns were fully absorbed with the nanosilver particles-containing solution.

(ii). The nanosilver particles-containing solution was removed from the yarns by dehydration such as using centrifugation. The yarn was further dried in an oven at 120–160° C. for about 40–60 minutes.

(iii). The dried yarns were washed by water, squeezed to dry, and dried again in the oven to obtain the antimicrobial yarn of the present invention which showed a yellow-orange color.

The process in (i) could be replaced with spraying the solution of (1) to the yarn by a jet sprayer.

EXAMPLE 3

Electron Microscopic Studies of the Antimicrobial Yarn (1) Purpose:

The yarn produced by the method described in Example 1 was analyzed for the dimension and distribution of nanosilver particles attached.

(2) Method:

Five samples of the antimicrobial yarn prepared in Example 1 (supra) was examined according to the procedure described in the JY/T011-1996 transmission electron microscope manual. JEM-100CXII transmission electron microscope was used with accelerating voltage at 80 KV and resolution at 0.34 nm.

(3) Results:

As shown in FIG. 1, all six batches of the antimicrobial yarn samples contained nanosilver particles which were evenly distributed to the yarn. Batch No. 010110 (FIG. 1A) contained about 62% of nanosilver particles that were under 10 nm in size, about 36% that were about 10 nm in size, and about 2% that were 15 nm in size. Batch No. 001226 (FIG. 1B) contained about 46% of nanosilver particles that were under 10 nm in size, about 47% that were about 10 nm in size, and about 7% that were about 15 nm in size. Batch number 001230 (FIG. 1C) contained about 65% of nanosilver particles that were under 10 nm in size, about 24% that were about 10 nm in size, and about 11% that were about 15 nm in size. Batch No. 010322-1 (FIG. 1D) contained about 89% of nanosilver particles that were under 10 nm in size, about 8% that were about 10 nm in size, and about 3% that were about 15 nm in size. Batch No. 011323 (FIG. 1E) contained about 90% of nanosilver particles that were under 10 nm in size, about 7% that were about 10 nm in size, and about 3% that were about 15 nm in size. Batch No. 010322-2 (FIG. 1F) contained 70% of nanosilver particles that were under 10 nm in size, about 12% that were about 10 nm in size, and about 13% that were about 15 nm in size. Chemical testing indicated that the silver content in the yarn was about 0.4–0.9% by weight.

(4) Conclusion:

The results as shown in FIG. 1 demonstrated that the antimicrobial yarn contained nanosilver particles with diameters below 20 nm. These nanosilver particles were evenly distributed to the yarn.

EXAMPLE 4

Broad Spectrum of Antimicrobial Activity of the Yarn (1) Purpose:

The antimicrobial yarn prepared in Example 1 was examined to determine the antimicrobial activity of the yarn.

(2) Method:

Both the antimicrobial yarn of the present invention (the experimental group) and the yarn without the attachment of nanosilver particles (the control group) were tested in the test tubes.

Microbial strains tested were *Escherichia coli*, Methicillin resistant *Staphylococcus aureus, Chlamydia trachomatis, Providencia stuartii, Vibrio vulnificus, Pneumobacillus, Nitrate-negative bacillus, Staphylococcus aureus, Candida albicans, Bacillus cloacae, Bacillus allantoides, Morgan's bacillus* (*Salmonella morgani*), *Pseudomonas maltophila, Pseudomonas aeruginosa, Neisseria gonorrhoeae, Bacillus subtilis, Bacillus foecalis alkaligenes, Streptococcus hemolyticus* B, Citrobacter, and *Salmonella paratyphi C*. These strains were either isolated from clinical cases or purchased as standard strains from Chinese Biological Products Testing and Standardizing Institute.

Two sets of test tubes, each containing a triplicate of various microbial strains were prepared by inoculating the microbial strains into the test tubes containing a meat broth. Then, equal weights of the yarns from the present invention and from the control were inserted into the test tubes. The test tubes were then cultured at 37° C. for 18–24 hours. At the end of the incubation, an aliquot of the broth from each of the test tube was taken out and spread onto a Trypticase soy blood agar plate. The blood agar plate was incubated at 37° C. for 18–24 hours.

(3) Results:

No colony or sign of any microbial growth was observed on the blood agar plate of the experimental group, as opposed to those of the control group where signs of microbial growth were seen.

(4) Conclusion:

The antimicrobial yarn of the present invention demonstrated effective antimicrobial activity against various bacteria, fungi, and chlamydia.

EXAMPLE 5

Long Lasting Effect of Antimicrobial Activity of the Yarn (1) Purpose:

The antimicrobial yarn of Example 1 of the present invention was examined for the antimicrobial activity over a prolonged period of time. The antimicrobial activity of the yarn after repeated washes was also conducted.

(2) Method:

The antimicrobial yarn of the present invention was washed according to the washing Procedure as provided in the *Functional Treatment of the Fabric*, Chinese Textile Publishing House (January 2001) as follows:

(i) 2 g of neutral soap solution (1:30) was dissolved in one litre of water to obtain a wash fluid;

(ii) A yarn from the experimental group or the control group as described in Example 4 was washed using the wash fluid of (i) at room temperature for 2 minutes;

(iii) The yarn was rinsed in water;

(iv) After every five washes in the wash fluid, the yarn was dried at 60° C.

(v) After 100 times of washing procedure according to (i) to (iv), nine batches of antimicrobial yarn were tested for antimicrobial activity on *Staphylococcus aureus, Escherichia coli, Candida albicans*, and *Pseudomonas aeruginosa* according to the method provided in Example 4.

(3) Results:

No colony or any signs of microbial growth were observed in the yarn of the experimental group, as opposed to those in the control group where signs of microbial growth were observed.

(4) Conclusion:

The above results indicate that the yarn of the present invention was very effective and long lasting as antimicrobial agent even after repeated washes.

EXAMPLE 6

Antimicrobial Activity of the Yarn Made with Different Materials or Dyed with Different Colors (1) Purpose:

The antimicrobial activity of the yarn of the present invention prepared from different materials or dyed with various colors was examined.

(2) Method:

(i) The yarn (from the experimental group or the control group) which was made from cotton, linen, silk, wool, leather, blending fabric, or synthetic fiber, or which was dyed in black, blue, red, orange, and yellow was prepared.

(ii) The yarns of (i) were tested for antimicrobial activity on *Staphylococcus aureus, Escherichia coli, Candida albicans*, and *Pseudomonas aeruginosa*, according to the method provided in Example 4.

(3) Results:

No colony or any signs of microbial growth were observed in the yarn of the experimental group, as opposed to those in the control group where signs of microbial growth were observed.

(4) Conclusion:

The antimicrobial yarn of the present invention made from different materials, which included cotton, linen, silk, wool, leather, blending fabric, or synthetic fiber, or dyed with different colors, was very effective as antimicrobial agent, suggesting the materials or dying methods would not and did not hinder the antimicrobial activity of the nanosilver particles-containing yarn.

While the invention has been described by way of examples and in terms of the preferred embodiments, it is to be understood that the invention is not limited to the disclosed embodiments. On the contrary, it is intended to cover various modifications as would be apparent to those skilled in the art. Therefore, the scope of the appended claims should be accorded the broadest interpretation so as to encompass all such modifications.

We claim:

1. A yarn comprising nanosilver particles attached to the fibers thereof, said nanosilver particles being 1–100 nm in diameter and made by reducing silver nitrate with a reducing agent and without using ammonia water.

2. A yarn comprising nanosilver particles attached to the fibers thereof, said nanosilver particles accounting for about 0.2 to 1.5% by weight of the total weight of said yarn.

3. A yarn according to claim 1, wherein said reducing agent is glucose, vitamin C, or hydrazine hydrate.

4. A yarn according to claim 1, wherein said fibers of said yarn are made of one or more types of material selected from the group consisting of cotton, linen, silk, wool, blending fabric, and synthetic fiber.

5. A yarn according to claim 1, which is dyed with a color or not dyed.

6. A yarn according to claim 1, which is used for the purpose of inhibiting growth of bacteria, fungi, or chlamydia.

7. A yarn according to claim 6, which is used for the purpose of inhibiting growth of *Escherichia coli, Methicillin resistant Staphylococcus aureus, Chlamydia trachomatis, Providencia stuartil, Vibrio vulnificus, Pneumobacillus, Nitrate-negative bacillus, Staphylococcus aureus, Candida albicans, Bacillus cloacae, Bacillus allantoides, Morgan's bacillus* (*Salmonella morgani*), *Pseudomonas maltophila*, Pseudomonas aeruginosa, Neisseria gonorrhoeae, Bacillus subtilis, Bacillus foecalis alkaligenes, Streptococcus hemolyticus B, Citrobacter,and *Salmonella paratyphi C*.

8. An antibacterial or antifungal cloth, which is made from a yarn according to claim 1.

9. An antibacterial or antifungal cloth according to claim 8, which is used to treat patient with burn and scald-related skin infection, wound-related skin infection, dermal or mucosal bacterial or fungal infection, surgery cut infection, vaginitis, or acne-related infection.

10. An antibacterial cloth according to claim 8, which is used to fabricate underwears, socks, shoe cushions, shoe linings, bed sheets, pillow shams, towels, women hygiene products, laboratory coat, or medical robes.

11. A method of fabricating a yarn of claim 1, comprising the steps of:

(a) mixing an aqueous solution of silver nitrate with an aqueous solution of a non-ammonia reducing agent to form a nanosilver particle-containing solution;

(b) soaking a conventional yarn in said nanosilver particle-containing solution or spraying said nanosilver particle-containing solution onto a conventional yarn; and (c) dehydrating or drying said conventional yarn that contains said nanosilver particle containing solution to form said yarn with antimicrobial activity.

12. A method according to claim 11, wherein said conventional yarn is pre-degreased before step (b).

13. A method according to claim 11, wherein said aqueous silver nitrate solution and said aqueous solution of reducing agent are mixed at 0–40° C. in step (a).

14. A method according to claim 11, wherein step (b) is performed by spraying said nanosilver particle-containing solution onto a conventional yarn.

15. A method according to claim 11, further comprising, after step (c), a step of treating said yarn with antimicrobial activity with heat at 120–160° C. for about 40–60 minutes.

16. A method according to claim 11, wherein said reducing agent is glucose, vitamin C, or hydrazine hydrate.

17. A method according to claim 11, wherein each liter of said nanosilver particle-containing solution comprises 2–40 g of silver nitrate and 0.5–62 g of reducing agent.

18. A method according to claim 17, wherein said reducing agent is glucose.

19. A method according to claim 17, wherein said silver nitrate and said glucose is at a ratio of about 0.03–80:1 by weight.

* * * * *

UNITED STATES PATENT AND TRADEMARK OFFICE

CERTIFICATE OF CORRECTION

PATENT NO. : 6,979,491 B1
APPLICATION NO. : 10/106033
DATED : December 27, 2005
INVENTOR(S) : Yan et al.

It is certified that error appears in the above-identified patent and that said Letters Patent is hereby corrected as shown below:

At column 4, line 11: the word "related" after the term "scald-related" should be deleted.
In claim 7, at column 11, line 36: the word "stuartil" should read --stuartii--.

Signed and Sealed this

Twenty-fifth Day of July, 2006

JON W. DUDAS
*Director of the United States Patent and Trademark Office*

UNITED STATES PATENT AND TRADEMARK OFFICE

CERTIFICATE OF CORRECTION

PATENT NO. : 6,979,491 B2
APPLICATION NO. : 10/106033
DATED : December 27, 2005
INVENTOR(S) : Yan et al.

It is certified that error appears in the above-identified patent and that said Letters Patent is hereby corrected as shown below:

At column 4, line 11: the word "related" after the term "scald-related" should be deleted.
In claim 7, at column 11, line 36: the word "stuartil" should read --stuartii--.

Signed and Sealed this

Fifteenth Day of August, 2006

JON W. DUDAS
*Director of the United States Patent and Trademark Office*